US006098799A

United States Patent [19]

Lee

[11] Patent Number: 6,098,799

[45] Date of Patent: Aug. 8, 2000

[54] SOCKET RECEIVING DEVICE

[76] Inventor: Jack Lee, No.53, Nan Shi Keng, Da Nan Village, May Shan Hsiang, Chia Yi Hsien, Taiwan

[21] Appl. No.: 09/330,205

[22] Filed: Jun. 11, 1999

[51] Int. Cl.[7] ..... B65D 85/28

[52] U.S. Cl. ..... 206/378; 206/350; 211/70.6

[58] Field of Search ..... 206/350, 376, 206/377, 378; 211/70.6

[56] References Cited

U.S. PATENT DOCUMENTS

| | | | |
|---|---|---|---|
| 5,316,143 | 5/1994 | Horn | 206/378 |
| 5,398,823 | 3/1995 | Anders | 211/70.6 |
| 5,456,359 | 10/1995 | Horn | 206/378 |
| 5,535,882 | 7/1996 | Liu | 206/377 |
| 5,855,285 | 1/1999 | Laird et al. | 211/70.6 |
| 5,897,001 | 4/1999 | Dembicks | 211/70.6 |
| 5,931,318 | 8/1999 | Shauo | 211/70.6 |

*Primary Examiner*—David T. Fidei
*Attorney, Agent, or Firm*—Charles E. Baxley

[57] ABSTRACT

A socket receiving device includes a base with a plurality of receiving units connected thereto, the receiving units disengagably connected with each other side by side. Each receiving unit has a recess defined therein and a protrusion extends from one of two closed end of each receiving unit. The other closed end of each receiving unit is a plate which is pivotally connected to the base. The plate has a plurality of apertures defined therethrough so that a wire extends through the socket in the recess and the aperture to secure the socket to the device.

10 Claims, 7 Drawing Sheets

SOCKET RECEIVING DEVICE

FIELD OF THE INVENTION

The present invention relates to a socket receiving device which has a plurality of receiving units removably connected to the base of the device, and a plate pivotally connected to the base such that wires are used to secure the plate to the sockets in the receiving units.

BACKGROUND OF THE INVENTION

A conventional socket receiving device is shown in FIG. 1 and includes a base member 10 and a transparent cover 11 which is removably connected to the base member 10. The base member 10 has a plurality of recesses 12 defined therein so as to receive sockets in the recesses 12. The transparent cover 11 allows the customers see the sockets in the recesses 12 via the transparent cover 11. When the socket receiving devices are displayed in a hardware store, the owner surely will be worry for the safety of the sockets 13 because it is easily to take the socket receiving devices from the display rack. The cover 11 cannot securely mounted to the base member 10 because the structure of the cover 11 and the base member 10 is so simple. Furthermore, when the socket receiving device is bought by the customers, the users have to receive the sockets in a suitable socket receiving device which is easily carried and conveniently used.

The present invention intends to provide a socket receiving device and the sockets are accessed and secured to the device by wires.

SUMMARY OF THE INVENTION

In accordance with one aspect of the present invention, a socket receiving device comprises a base having a board and two end walls extending from the two ends of the board. A plate is pivotally connected to one of two sides of the board. A plurality receiving units are securely connected between the two end walls of the base, wherein each receiving unit has a recess defined therein which is defined by two sidewalls and a closed end. The sidewalls of each receiving unit respectively have a first engaging means and a second engaging means so that the receiving units are connected with each other by engaging the first engaging means with the second engaging means.

The main object of the present invention is to provide a socket receiving device which has receiving units connected thereto wherein the receiving units are disengagably connected with each other.

Another object of the present invention is to provide a socket receiving device wherein the plate has apertures so that a wire extends through the socket in the receiving unit and the aperture to secure the socket to the socket receiving device of the present invention.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
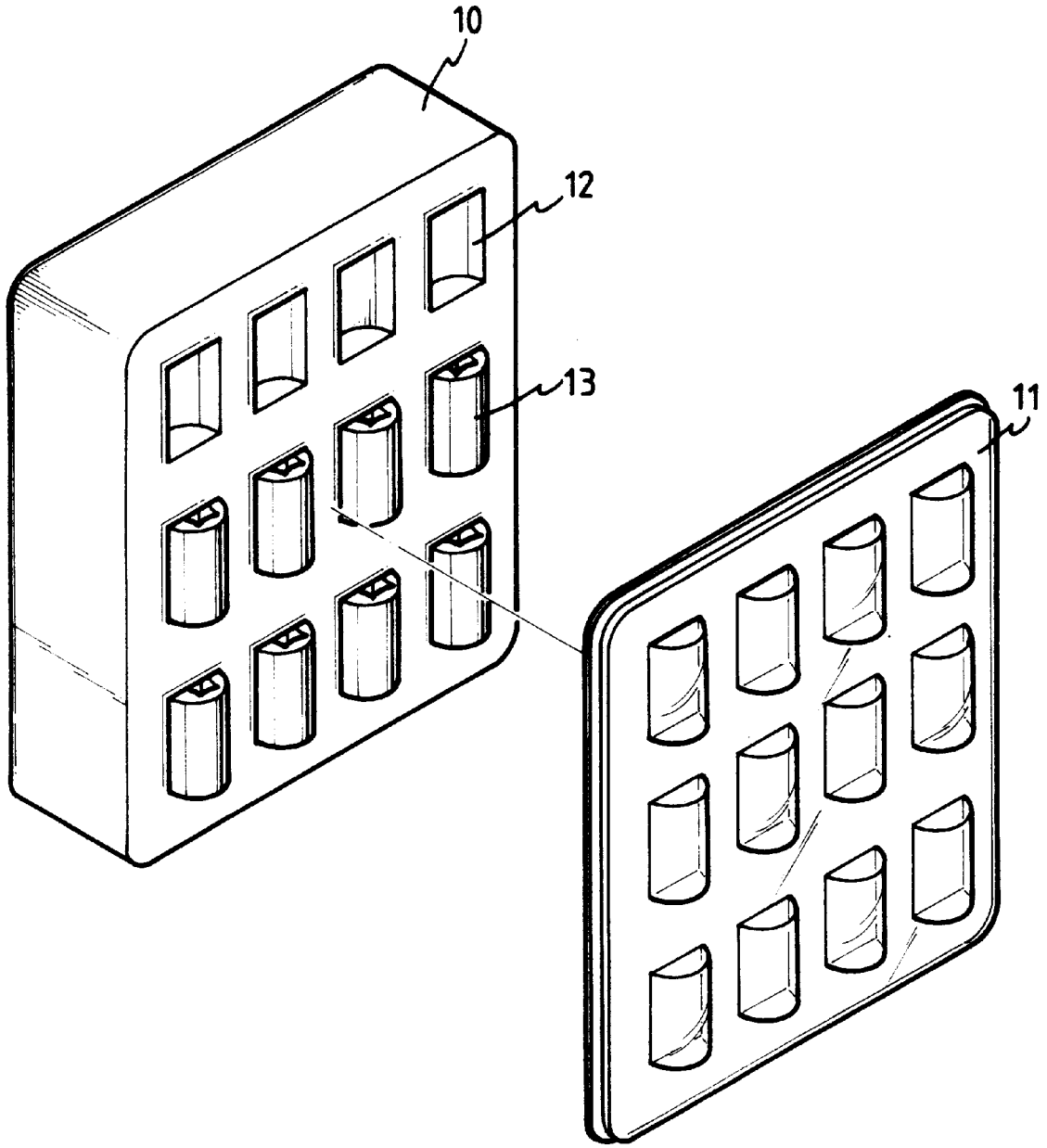
FIG. 1 PRIOR ART
FIG. 1 is an exploded view of a conventional socket receiving device.
Figure 2:
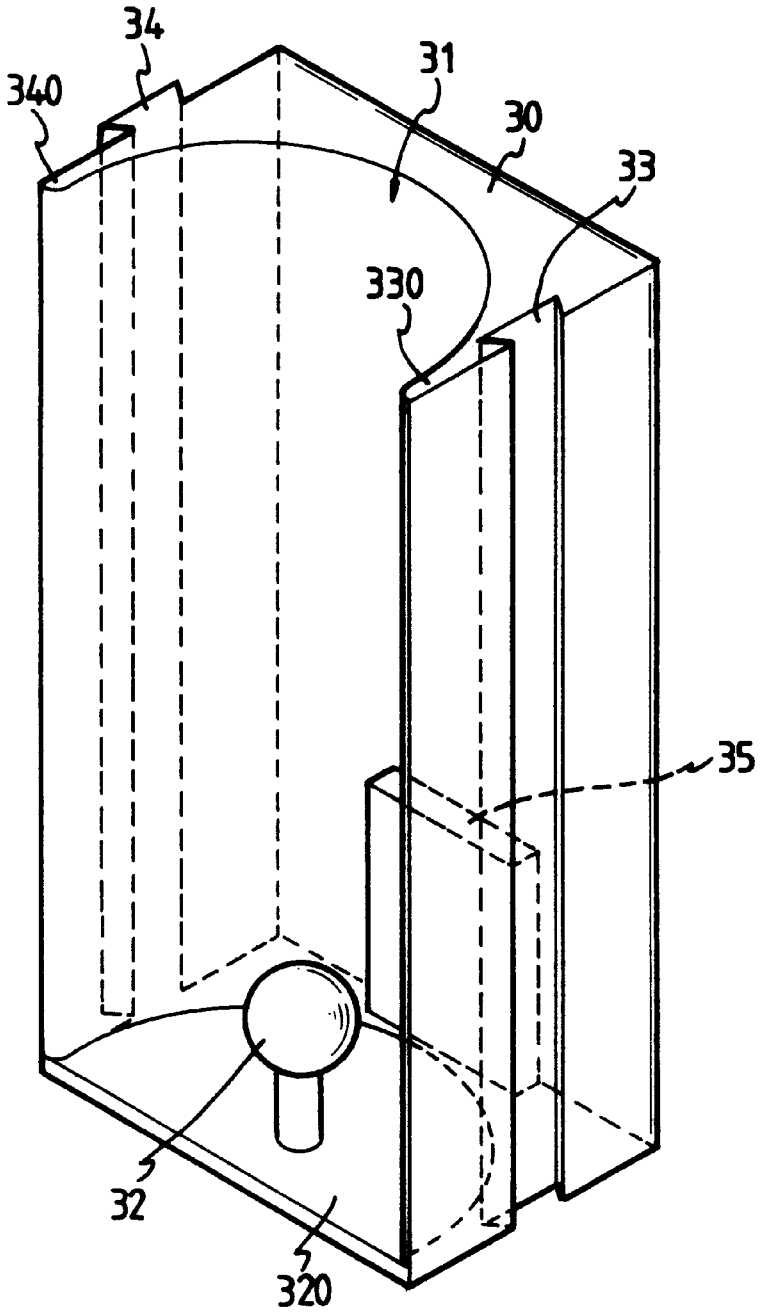
FIG. 2 is a perspective view of a receiving unit in accordance with the present invention.
Figure 3:
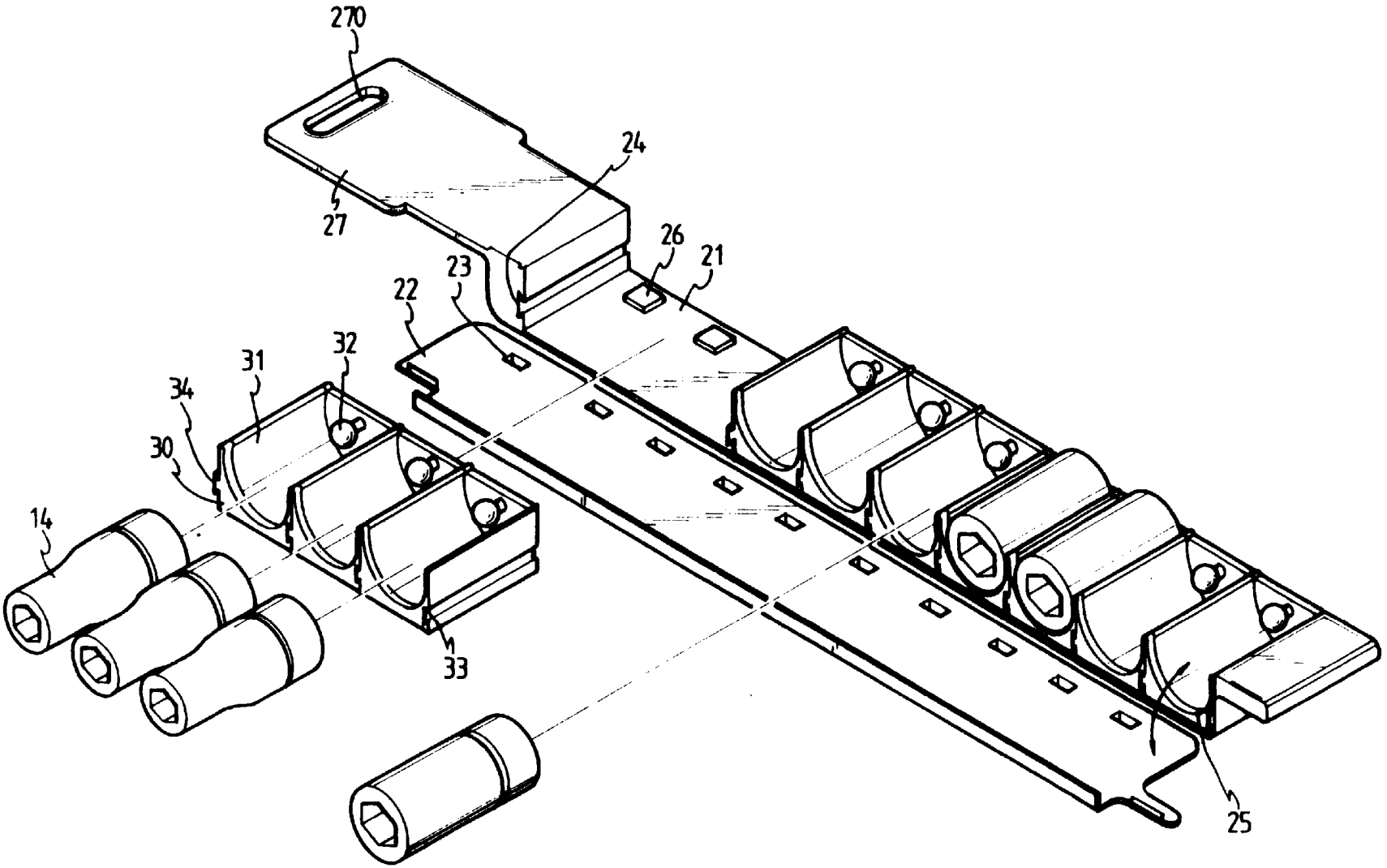
FIG. 3 is an exploded view of the socket receiving device in accordance with the present invention.
Figure 4:
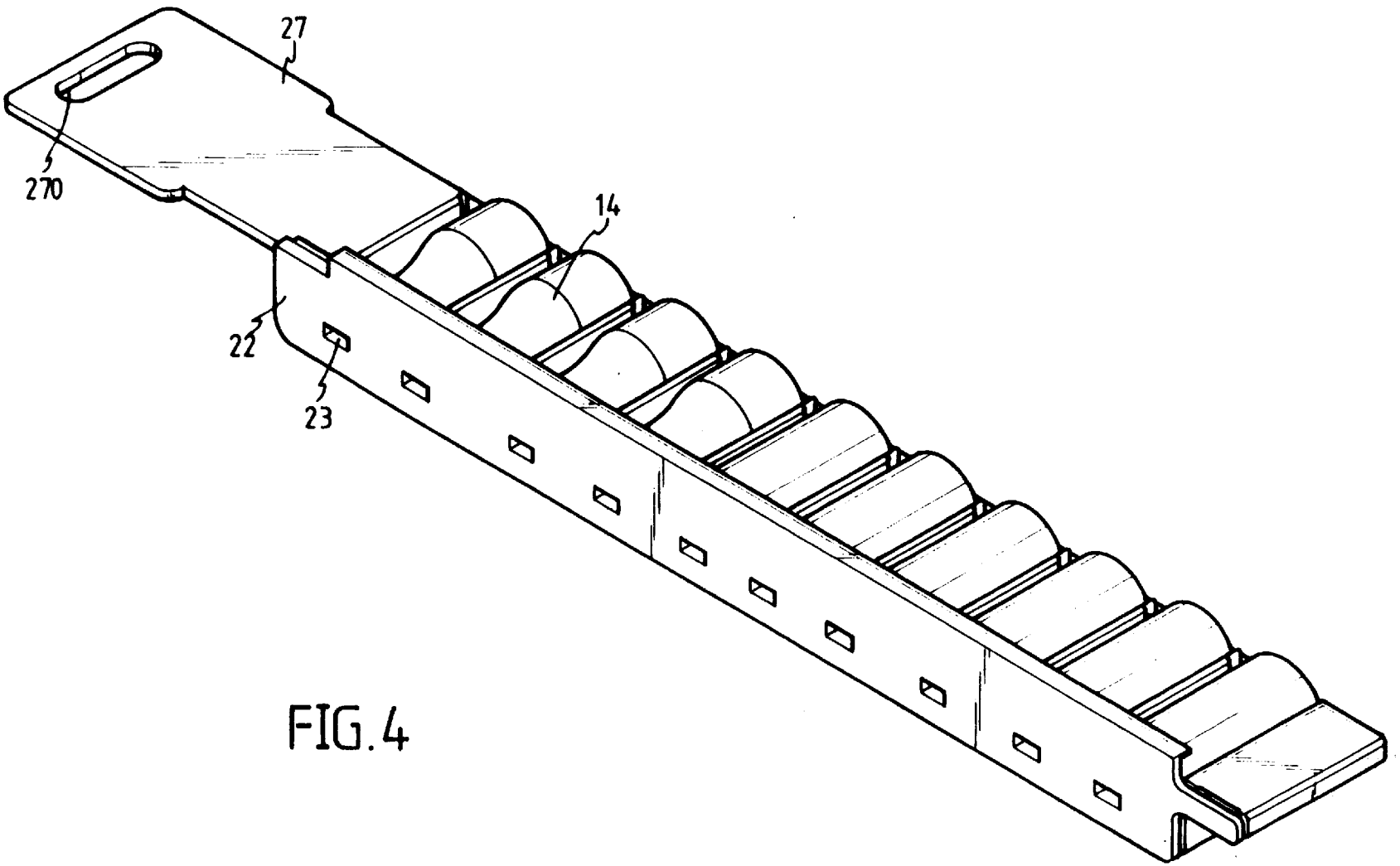
FIG. 4 is a perspective view of the socket receiving device in accordance with the present invention.

Referring to FIGS. 2 to 4, the socket receiving device in accordance with the present invention comprises a base 20 having a board 21 and two end walls respectively extending from the two ends of the board 21, a plate 22 pivotally connected to one of two sides of the board 21. One of the end walls of the base 20 has a tongue member 27 extending therefrom which has a hole 270 defined therethrough.

A plurality receiving units 30 are securely connected between the two end walls of the base 20, wherein each receiving unit 30 has a recess 31 defined therein so as to receive a socket 14 therein. Each recess 31 is defined by two sidewalls 330, 340 and a closed end 320. The closed end 320 is connected between the two sidewalls 330, 340 and has a protrusion 32 extending in the recess 31. In this embodiment, the protrusion 32 is a sphere member which is engaged with one of two openings of the socket 3. The sidewall 330 has a first engaging means 33 which is a dove-tailed groove, and the sidewall 340 has a second engaging means 34 which is a dove-tailed ridge. Therefore, the receiving units 30 are connected with each other by engaging the first engaging means 33 with the second engaging means 34. It is noted that the two end walls of the base 20 respectively have a dove-tailed groove 24 and a dove-tailed ridge 25 so that the connected receiving units 30 can be securely connected between the two end walls by engaging the first engaging means 33 with the dove-tailed ridge 25 and engaging the second engaging means 34 with the dove-tailed groove 24.

The board 21 has a plurality of positioning blocks 26 extending therefrom and each receiving unit 30 has a notch 35 defined in the outside thereof so that each positioning block 26 is received in the notch 35 corresponding thereto. By this manner, the receiving units 30 are positioned on the board 26.

Figure 5:
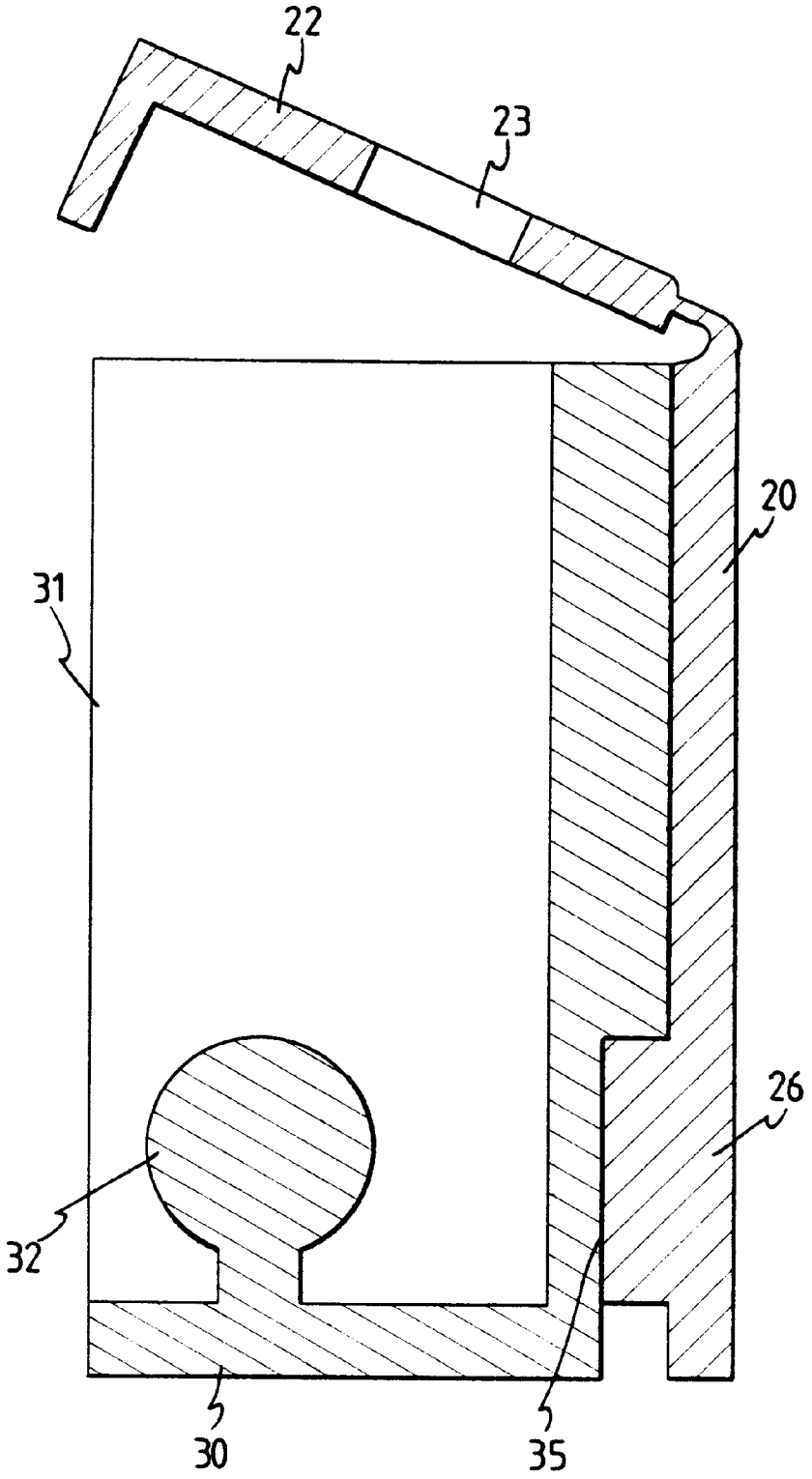
FIG. 5 is a side elevational view, partly in section, of the socket receiving device in accordance with the present invention, wherein the plate is not yet engaged with the base of the device.
Figure 6:
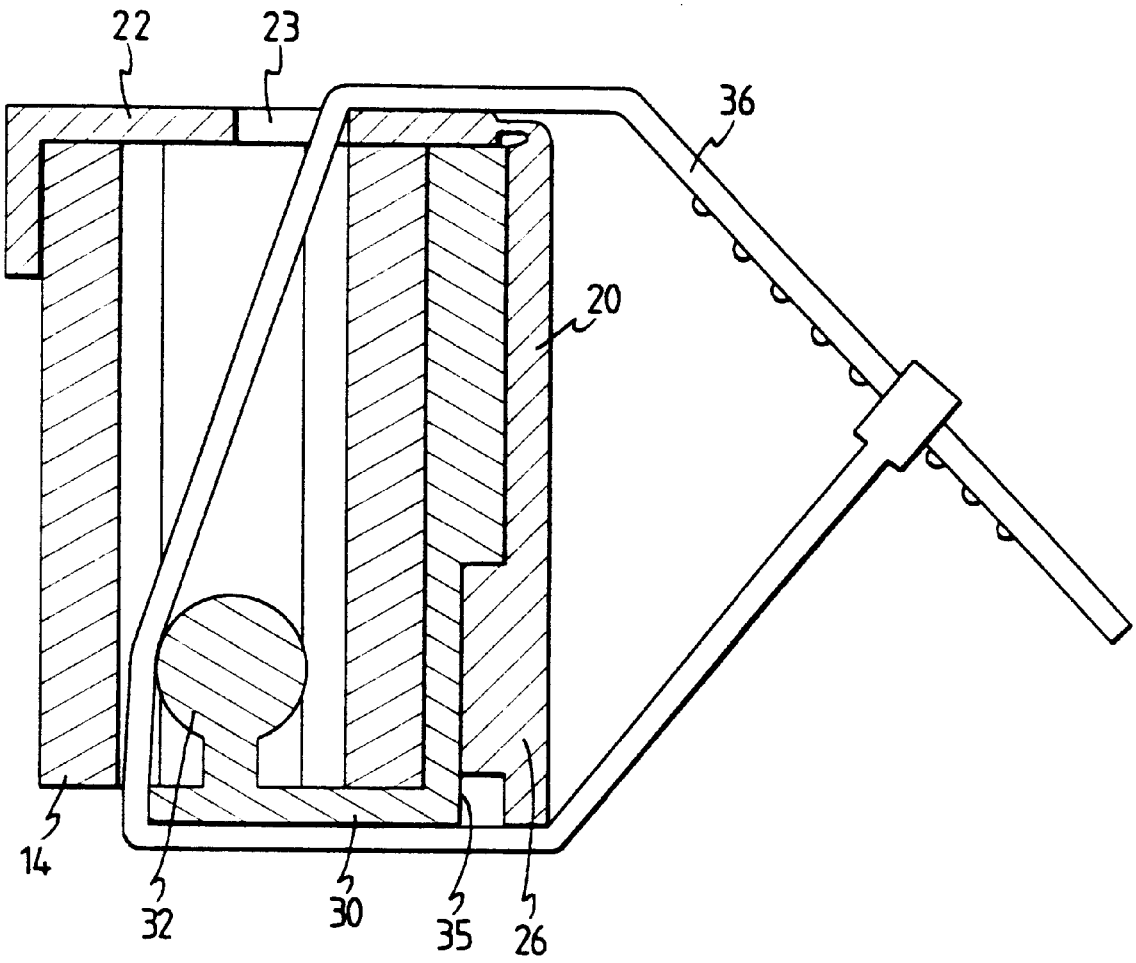
FIG. 6 is a cross sectional view to show a wire extending through the socket in the receiving unit and the aperture in the plate.

Further referring to FIG. 5, the plate 22 has a plurality of apertures 23 defined therethrough and the plate 22 can be engaged to the base 20 to close the open end of the receiving units 30. Therefore, as shown in FIG. 6, a wire 36 extends through the socket 14 and the aperture 23 of the plate 22, and the two ends of the wire 36 are securely fastened with each other so that the socket 14 is securely connected to the base 20.

The sockets 14 received in the receiving units 30 can be seen and touched, but cannot be separated from the base 20.

Figure 7:
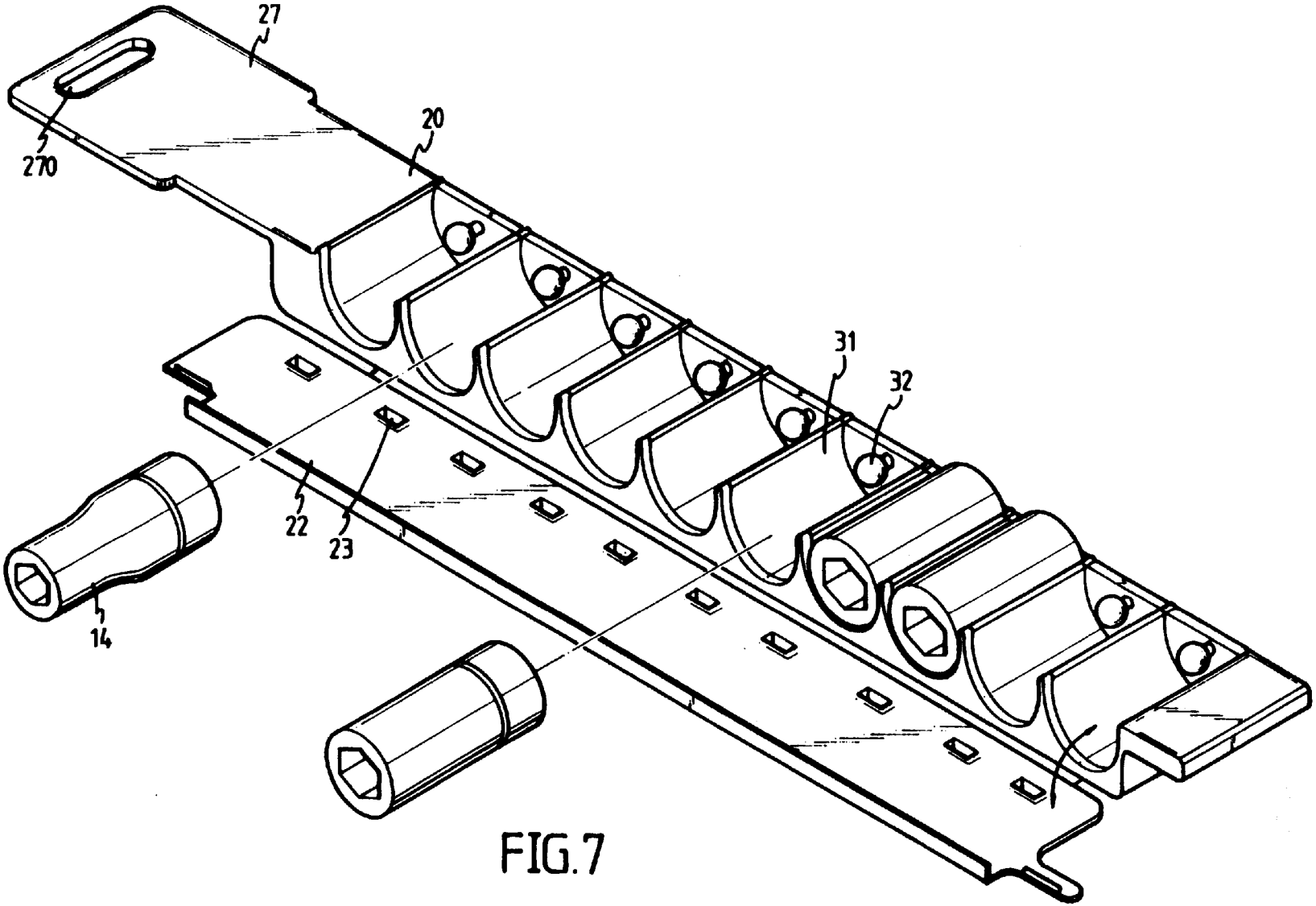
FIG. 7 is an exploded view of another embodiment of the socket receiving device in accordance with the present invention.

Another embodiment of the socket receiving device is shown in FIG. 7 and comprises a base 20 having a plurality of recesses 31 defined in a top surface thereof and each recess 31 defined by a closed end and two sidewalls. Each closed end has a sphere protrusion 32 extending therefrom so as to engage with the opening of the socket 14 to be received in the recess 31. The base 20 has a tongue member 27 extending from one of two ends thereof and the tongue member 27 has a hole 270 defined therethrough.

A plate 22 is pivotally connected to the base 20 and located in opposite to the closed end of each recess 31. The plate 22 has a plurality of apertures 23 defined therethrough so as to use a wire as shown in FIG. 6 to secure the socket 14.

While we have shown and described various embodiments in accordance with the present invention, it should be clear to those skilled in the art that further embodiments may be made without departing from the scope and spirit of the present invention.

What is claimed is:

1. A socket receiving device comprising:

a base having a board and two end walls respectively extending from the two ends of said board, a plate pivotally connected to one of two sides of said board, and a plurality receiving units securely connected between said two end walls of said base, each receiving unit having a recess defined therein which is defined by two sidewalls and a closed end, said closed end connected between said two sidewalls, said sidewalls of each receiving unit respectively having a first engaging means and a second engaging means so that said receiving units are connected with each other by engaging said first engaging means with said second engaging means.

2. The device as claimed in claim 1, wherein each receiving unit has a protrusion extending from said closed end.

3. The device as claimed in claim 1, wherein said protrusion is a sphere member.

4. The device as claimed in claim 1, wherein said plate has a plurality of apertures defined therethrough.

5. The device as claimed in claim 1, wherein said board has a plurality of positioning blocks extending therefrom and each receiving unit has a notch defined in the outside thereof so that each positioning block is received in said notch corresponding thereto.

6. The device as claimed in claim 1, wherein one of said end walls of said base has a tongue member extending therefrom which has a hole defined therethrough.

7. A socket receiving device comprising:

a base having a plurality of recesses defined in a top surface thereof and each recess defined by a closed end and two sidewalls, each closed end having a protrusion extending therefrom, and a plate pivotally connected to said base and located in opposite to said closed end of each recess.

8. The device as claimed in claim 7, wherein said protrusion is a sphere member.

9. The device as claimed in claim 7, wherein said plate has a plurality of apertures defined therethrough.

10. The device as claimed in claim 7, wherein said base has a tongue member extending from one of two ends thereof and said tongue member has a hole defined therethrough.

* * * * *